US006848149B1

(12) United States Patent
Baechler

(10) Patent No.: US 6,848,149 B1
(45) Date of Patent: Feb. 1, 2005

(54) METHOD AND DEVICE FOR IDENTIFYING AND EXPELLING FOREIGN MATERIAL IN A STREAM OF FIBERS CONSISTING OF COMPRESSED TEXTILE FIBERS

(75) Inventor: François Baechler, Wermatswil (CH)

(73) Assignee: Uster Technologies AG, Uster (CH)

( * ) Notice: Subject to any disclaimer, the term of this patent is extended or adjusted under 35 U.S.C. 154(b) by 0 days.

(21) Appl. No.: 10/168,110

(22) PCT Filed: Dec. 11, 2000

(86) PCT No.: PCT/CH00/00657

§ 371 (c)(1),
(2), (4) Date: Nov. 25, 2002

(87) PCT Pub. No.: WO01/44545

PCT Pub. Date: Jun. 21, 2001

(30) Foreign Application Priority Data

Dec. 16, 1999 (CH) ..... 2308/99

(51) Int. Cl.[7] ..... D01B 3/04
(52) U.S. Cl. ..... 19/65 R; 19/200
(58) Field of Search ..... 19/65 R, 105, 19/107, 200, 201, 203, 205, 204; 57/264, 265; 73/159, 160; 209/580, 587, 588, 938; 250/223 R, 226; 356/402; 492/9, 10, 11, 33, 36

(56) References Cited

U.S. PATENT DOCUMENTS 4,858,277 A * 8/1989 Pinto et al. ..... 19/200
5,205,019 A * 4/1993 Schnlichter et al. ..... 19/200
5,469,253 A * 11/1995 Shofner et al. ..... 356/238.3
5,539,515 A * 7/1996 Shofner et al. ..... 356/238.3
5,692,267 A * 12/1997 Leifeld ..... 19/106 R
5,692,622 A 12/1997 Hergeth
5,761,771 A * 6/1998 Leifeld ..... 19/200

FOREIGN PATENT DOCUMENTS

| | | |
|---|---|---|
| DE | 43 40 173 A | 6/1995 |
| EP | 0 879 905 A | 11/1998 |
| WO | 94 09355 A | 4/1994 |

* cited by examiner

*Primary Examiner*—Gary L. Welch
(74) *Attorney, Agent, or Firm*—Burns, Doane, Swecker & Mathis, L.L.P.

(57) ABSTRACT

The invention relates to a method and a device for identifying and expelling foreign material in a stream of fibres consisting of compressed textile fibres. To provide a method and a device which continuously check the stream of fibres in industrial use also at high speeds, the checking conditions being constant over a long period, the stream of fibres is compressed in portions (62), driven by positive fit, optically detected and inspected for the presence of foreign material. The device has at least one roller-shaped element (14, 15) provided with teeth (21, 22) for engagement in the stream of fibres, between which teeth (21, 22) light-transmitting elements (23, 24) are arranged.

6 Claims, 7 Drawing Sheets

Figure 1:
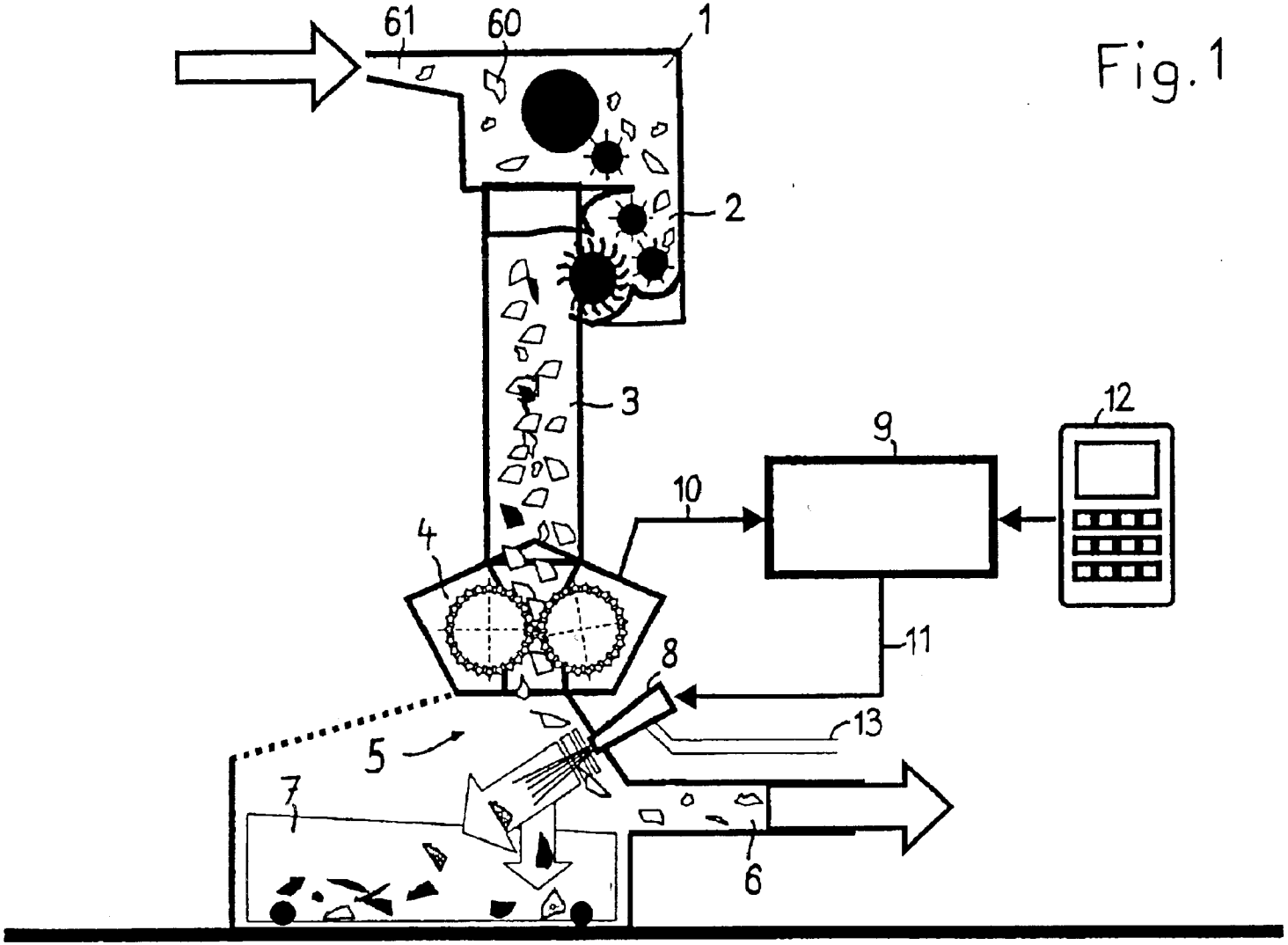

METHOD AND DEVICE FOR IDENTIFYING AND EXPELLING FOREIGN MATERIAL IN A STREAM OF FIBERS CONSISTING OF COMPRESSED TEXTILE FIBERS

Priority is claimed to PCT Patent Application Number PCT/CH00/000657 filed on Dec. 11, 2000, which claims priority to 2308/99 filed in Switzerland filed on Dec. 16, 1999, both herein incorporated by reference.

The invention relates to a method and process for identifying and expelling foreign material in a stream of fibres consisting of compressed textile fibres.

A machine for detecting foreign parts in streams of fibres is known from DE 44 15 907 in which the fibres are compressed in a shaft and are guided past a row of colour sensors. In order, on the one hand, to be able to identify the foreign parts by their colour, which in general differs from the colour of the fibres to be inspected, the background is kept to a colour which is similar to the fibres to be inspected. On the other hand, the background is formed by a roller or a conveyor belt, the surface of which has clear structuring promoting the movement of the fibres.

A drawback of this machine is that the surface of the conveyor belt or roller having a surface made of rubber discolours over time owing to the action of light and dirt and periodically has to be replaced. This is also because the structure of the surface changes over time, in particular it becomes soiled. In addition, this design with the moved background is expensive and leads to the fibres only being seen from one side for observation and measurement. In addition, the machine must be in a position to differentiate between three colour stages, namely one for the background, one for the flocks consisting of good fibres and one for the foreign material and this places high demands on the optical elements.

An apparatus is also known from WO 95/16909 for "on-line" detection of impurities in white fibre mass in which the fibre mass is guided between two rollers which oppose one another, the one roller consisting of a transparent material. Downstream from the roller consisting of transparent material is arranged a lens system with a detector which receives light from the fibre mass which passes through the transparent roller. The fibre mass is driven by two respective drafting device cylinders on either side of the roller consisting of transparent material.

A drawback of this apparatus is that a strip, which is at most four millimetres wide, of the previously rolled fibre material is detected thereby in order to be able to use a photodiode line as detector. This means that this apparatus is only suitable for very thin fibre masses and low speeds. It cannot be enlarged at random to inspect thicker fibre masses as in this case the combination of the transparent roller and the evaluation unit arranged next to the roller would not allow a satisfactory operating mode. This apparatus is therefore not suitable for industrial use for checking raw materials for the production of textiles.

The invention as characterized in the claims therefore achieves the object of providing a method and a device avoiding said drawbacks and allowing the stream of fibres to be continuously checked in industrial use, even at high speeds, the checking conditions being constant over a long period.

The object is achieved in that the stream of fibres is compressed in portions, driven by positive fit, optically detected and inspected for the presence of foreign material. The stream of fibres is preferably driven by positive fit over offset portions where the optical detection also takes place.

The optically detected portions have a limited and adjustable thickness. For optical detection the light of a light source reflected by the stream of fibres is split into a plurality of colours and a signal is obtained from each colour which is separately evaluated to detect foreign material responding particularly strongly to one colour.

The device has at least one roller-shaped element having elements for engagement with positive fit in the stream of fibres and for driving the stream of fibres, light-transmitting elements being arranged between these elements. The roller-shaped element may, however, also be designed to be transparent in its entirety. Two roller-shaped elements are arranged opposing one another, the elements of which are designed as teeth for engagement with positive fit, mesh with one another without contact and form a continuous measuring duct with offset portions for the fibre steam. Light-transmitting elements are arranged side by side in columns and rows on the roller-shaped element. Attached to a plurality of optical evaluation modules is a common evaluation unit connected in one position of the roller-shaped element to a respective optical transmitting device. The evaluation module has filters to separate the reflected light into a plurality of defined colours. The evaluation unit with the evaluation modules is preferably arranged in a roller-shaped element. The stream of fibres is preferably optically detected from both sides.

The advantages achieved by the invention are in particular that a homogenised portion is formed in the stream of fibres for the detection of the foreign material, in that only fibres and possibly present foreign materials appear. The device simultaneously serves to convey with positive fit the stream of fibres in the measuring duct. It is possible to detect the stream of fibres from two sides and this allows detection of the foreign material with increased reliability without the device requiring too large an amount of space for this purpose. The reliability mentioned is increased by the stream of fibres only having a small and adjustable thickness for measurement. The fibre material is guided and compressed upstream from the sensors, so that it appears as a surface area and this allows the stream of fibres to appear homogeneous thus reducing the formation of shadows and increasing the contrast to differing colours as the background in front of which detection is carried out, does not appear at all. The use of photodiodes to detect the light further increases the precision of detection. The proposed solution also allows the use of light-emitting diodes with white light as the light source and this produces less heating and more uniform light over a longer period in contrast to halogen light.

The invention will be described in more detail hereinafter with the aid of an example and with reference to the attached drawings, in which:

FIG. 1 is a schematic view of the device according to the invention

Figure 2:
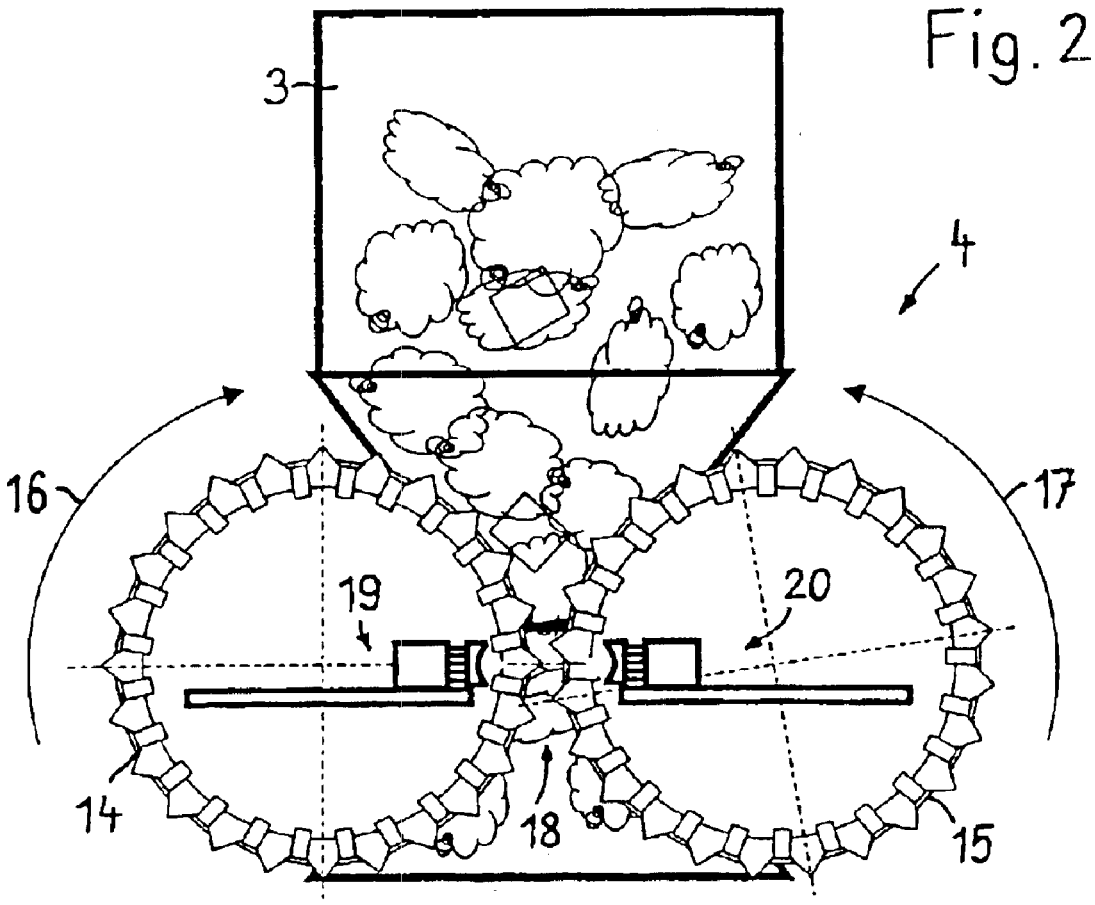
Figure 3:
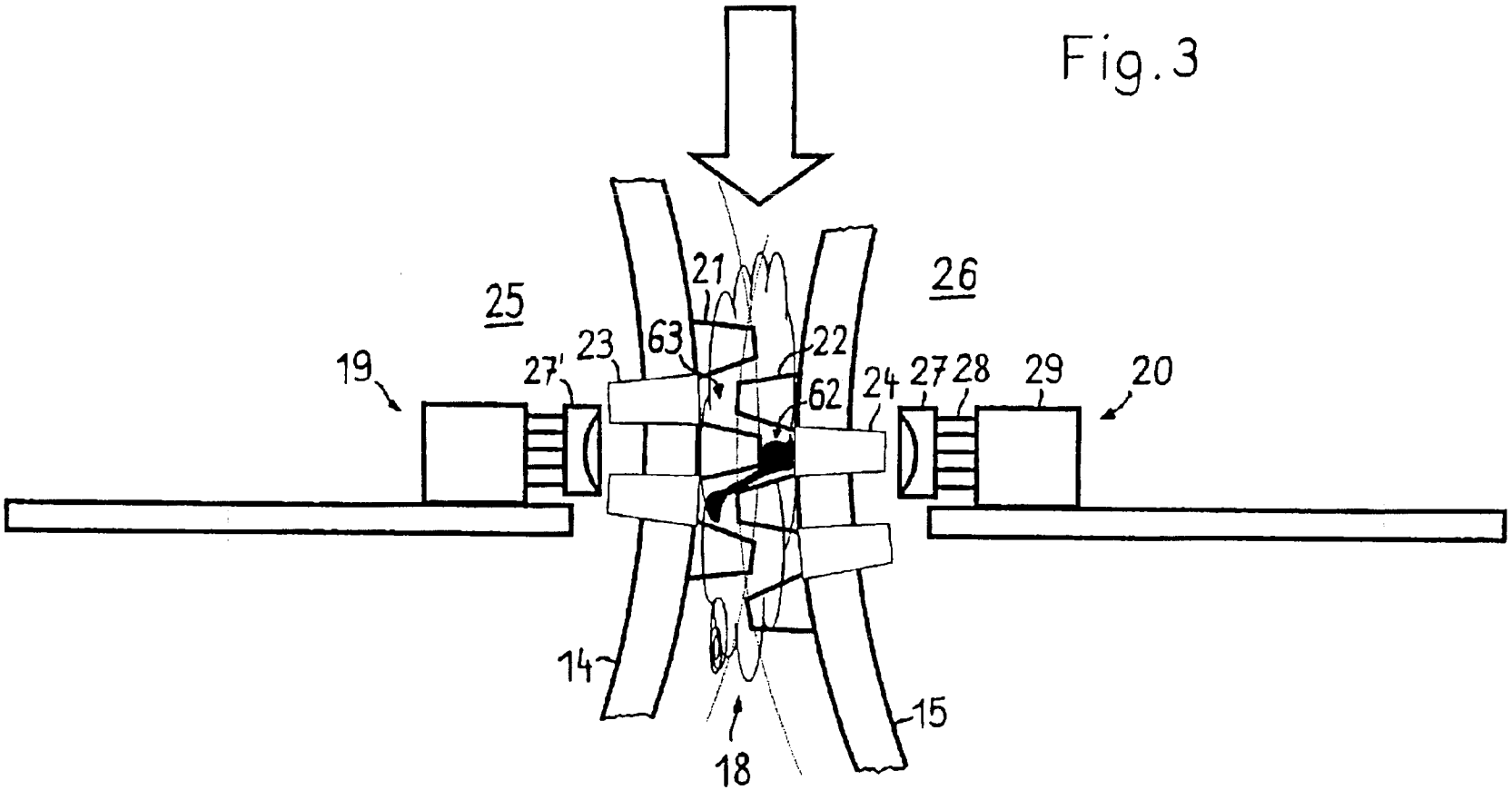
Figure 4:
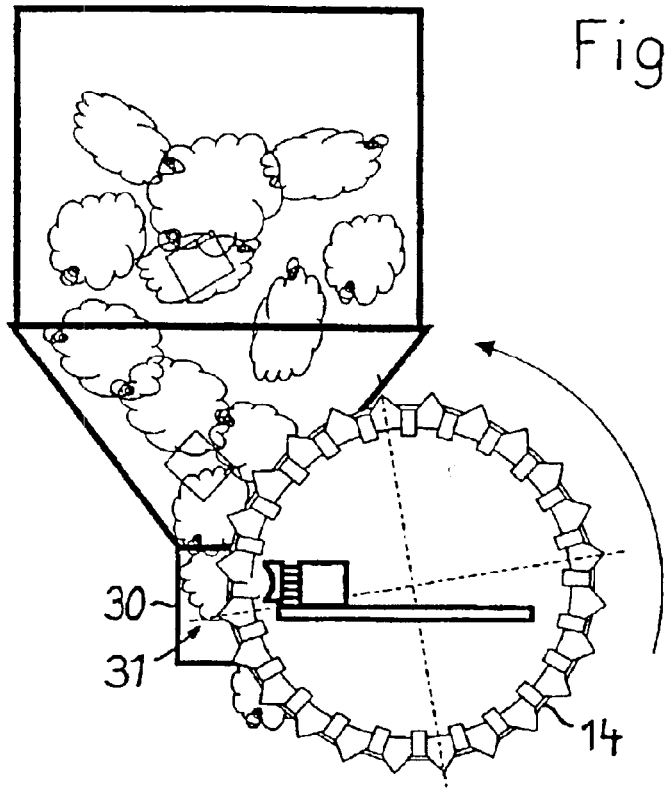
Figure 5:
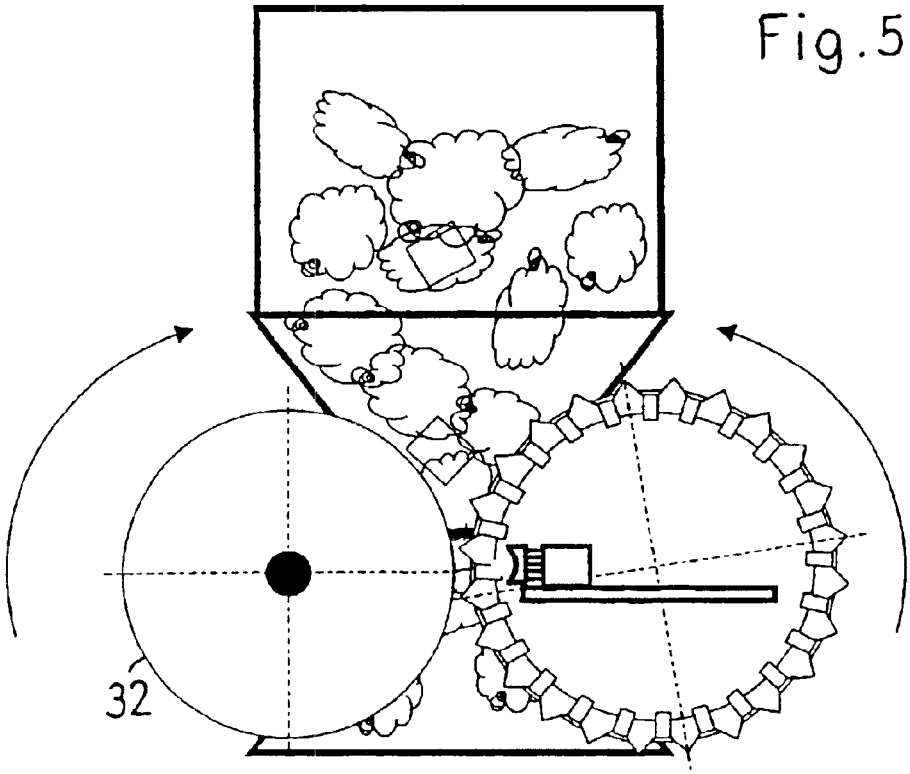
Figure 9:
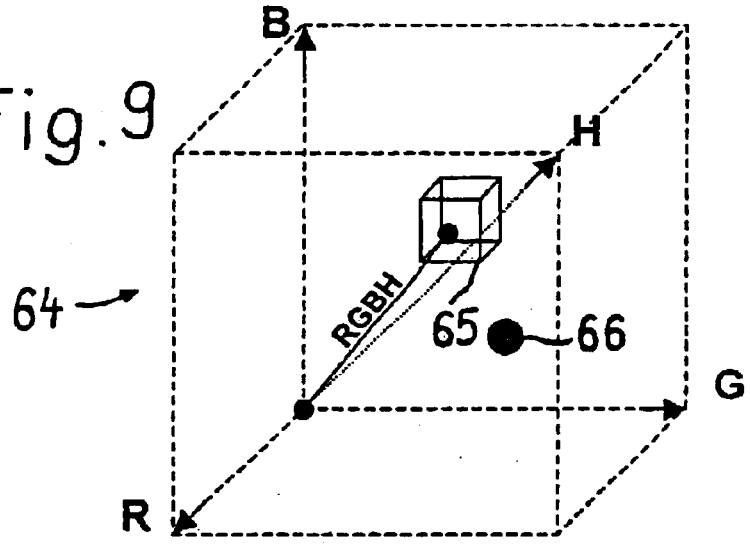
Figure 6:
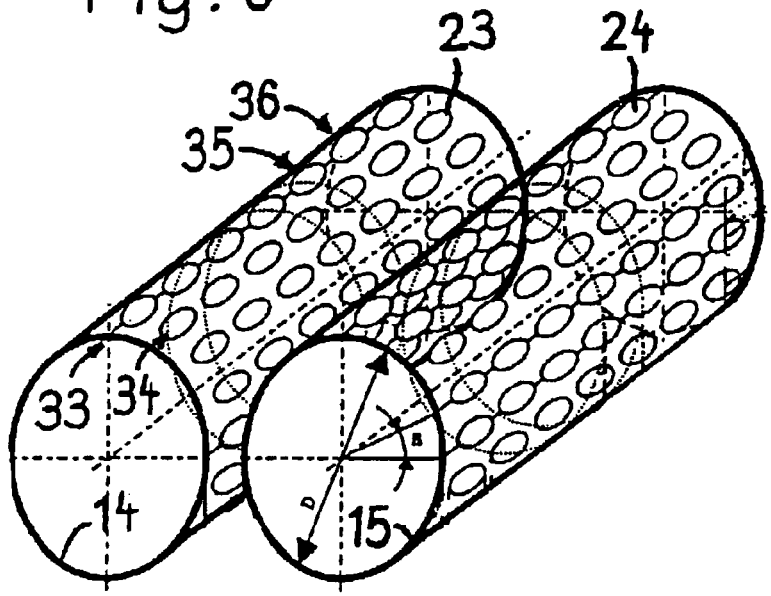
Figure 7:
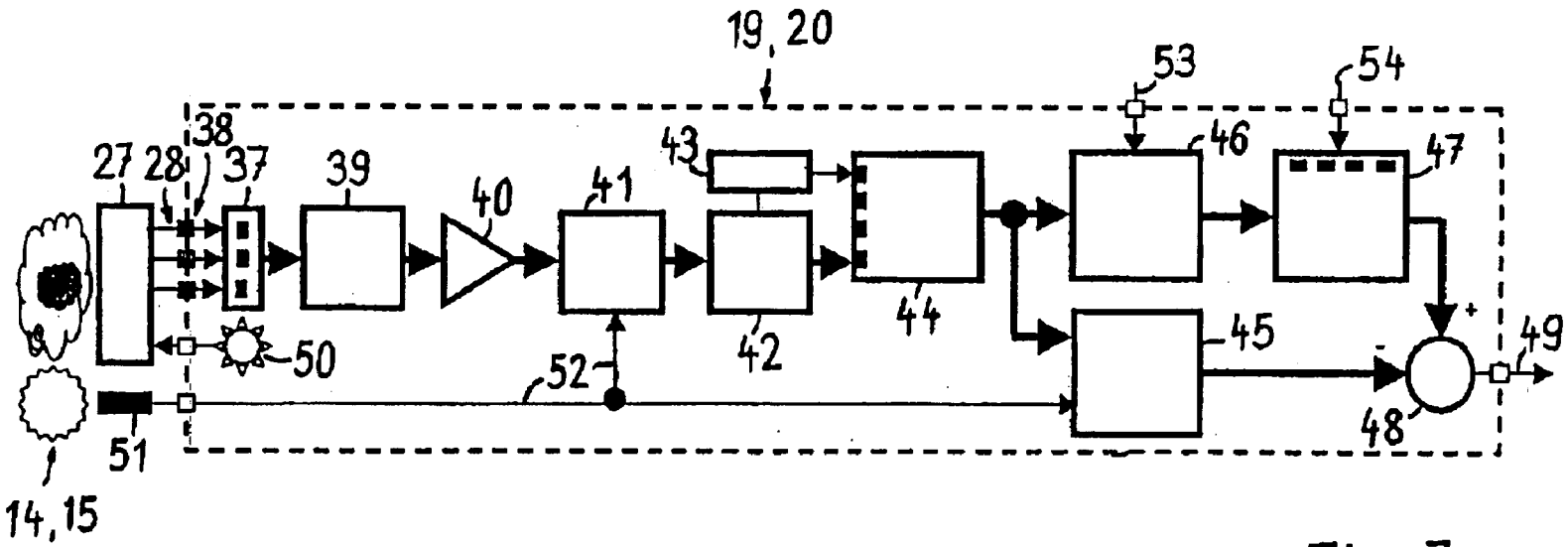
Figure 8:
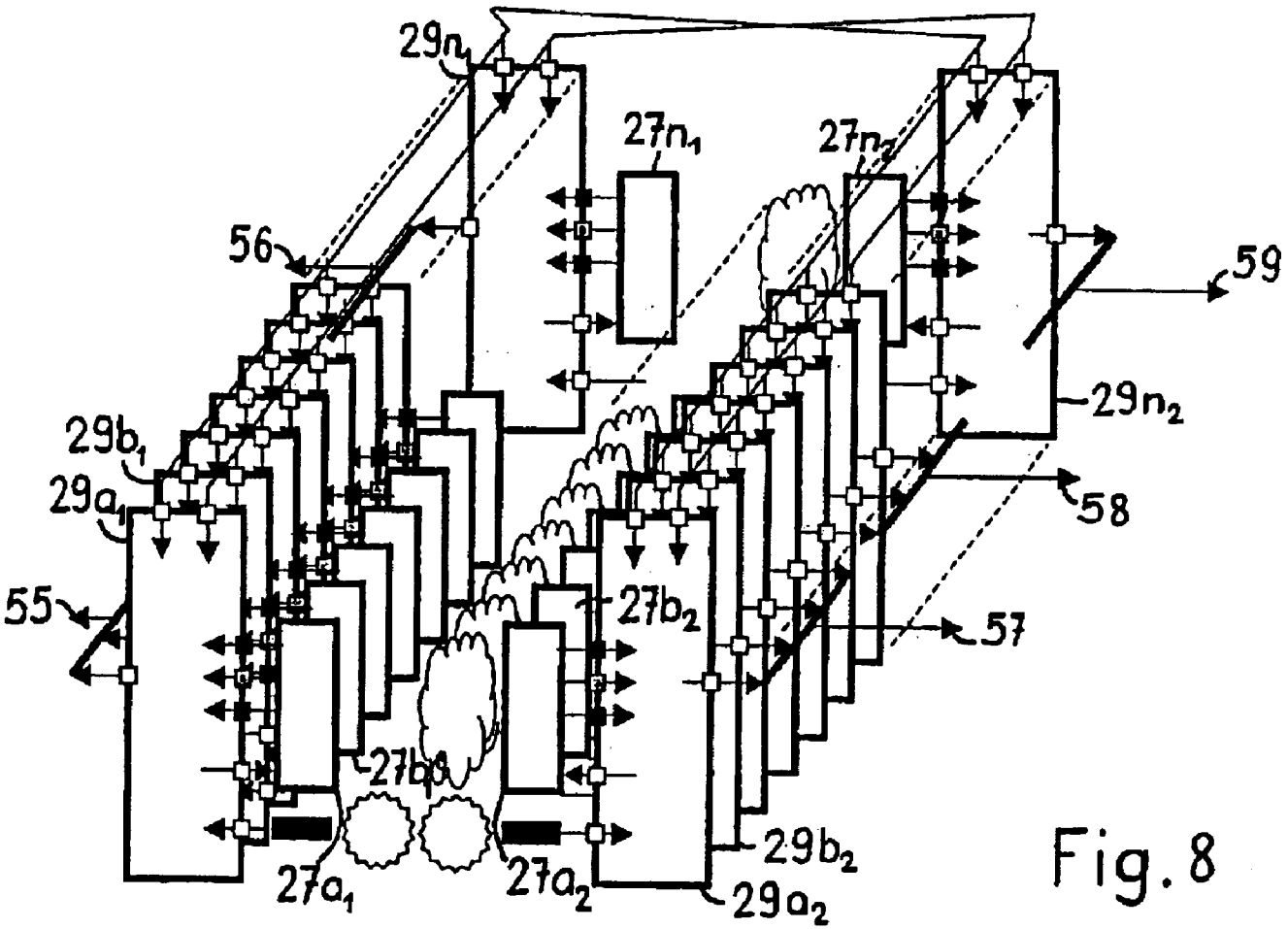

FIGS. 2, 3 and 6 are each a schematic view of a part of the device according to FIG. 1, FIGS. 4 and 5 are each a further design of the device, FIG. 7 is a block diagram of a part of the device and FIGS. 8 and 9 are a schematic view of run-offs in the device.

FIG. 1 shows a device consisting of the following processing stages: condenser 1, opener 2, retaining duct 3, foreign material detection device 4, foreign material separating device 5 and discharge duct 6 for cleaned fibre material. In addition, further parts can be seen such as: foreign material collector 7, separating device 8, control unit 9, measuring connection 10, control connection 11, input and output unit 12, and a compressed air line 13 for the separating device 8.

FIG. 2 shows in more detail the stage for the foreign material detection device 4. Two roller-shaped elements 14 and 15 can be seen therein which are driven separately or synchronously and move in the direction of arrows 16 and 17. The elements 14 and 15 delimit a measuring duct 18 into which the retaining duct 3 opens, the cross-section of the measuring duct 18 being substantially smaller, however, than that of the retaining duct 3. An optical evaluation unit 19 and 20 is respectively stationarily arranged for signal processing in the roller-shaped elements 14 and 15.

FIG. 3 shows a part of the foreign material detection device 4 according to FIG. 2, the measuring duct 18, parts of the roller-shaped elements 14 and 15 and the evaluation unit 19 and 20 for signal processing being visible again. At the periphery of the roller-shaped elements 14 and 15 are arranged teeth 21 and 22 meshing with one another, without contacting one another, so a measuring duct 18 always remains continuously open between the teeth 21, 22'. Arranged between or next to the teeth 21, 22 on the roller-shaped elements are transparent light-transmitting elements such as, preferably, lenses 23, 24 producing a light-transmitting connection between the measuring duct 18 and the interior 25, 26 of the roller-shaped elements 14, 15. Each evaluation unit 19, 20 for signal processing consists of a plurality of optical evaluation modules equipped with a lens or a lens system 27, a plurality of colour filters and light-transmitting elements 28 and optical transformers 29 for signal processing.

FIG. 4 shows a device with a roller-shaped element 14 arranged in front of a wall 30, so a duct 31 for the stream of fibres forms between the element 14 and the wall 30.

In place of the wall a simple but driven roller 32 can also be provided as shown in FIG. 5.

FIG. 6 shows a simplified view of a part of the structure of the roller-shaped elements 14, 15 on which transparent light-transmitting elements 23, 24 are arranged in rows 33, 34 and columns 35, 36.

FIG. 7 is a schematic view of the evaluation units 19, 20 with the lenses or lens systems 27 and the light-transmitting elements 28. They are connected via colour filters 38 to measuring elements 37 for the intensity of the filtered light. Attached thereto in series are a current-voltage transformer 39, an amplifier 40 and an analogue/digital transformer 41. This is attached to an element 42 for linearisation and standardisation. This is in turn connected, on the one hand, to a circuit for evaluating the light intensity 43 and, on the other hand, directly to a memory 44 for the individual filtered colour values and the entire colour intensity. This memory 44 is in turn connected, on the one hand to a unit 46 for establishing nominal colour values and to a time delay circuit 45. A unit 47 for determining and storing tolerance values is connected to the unit 46, and this unit 47 is again connected to a comparator 48. The comparator 48 is also connected to the delay circuit 45 and determines the state of an output 49. A light-transmitting element 28 is also connected to a light source 50. A position sensor 51 constantly measures the position of the roller-shaped elements 14, 15. The position sensor 51 controls, via a line 52, the analogue/digital transformer 41 and the delay circuit 45. Determination of the nominal colour values can be triggered via a terminal 53. Tolerance values are determined via a terminal 54.

FIG. 8 is a schematic view of the evaluation units 19, 20 in the two roller-shaped elements 14, 15. Therefore a plurality of lenses or lens systems $27a_1$ to $27n_1$ and $27a_2$ to $27n_2$ and a plurality of evaluation circuits $29a_1$ to $29n_1$ and $29a_2$ to $29a_n$ are arranged side by side here. A lens or a lens system 27 with an evaluation circuit 29 is associated with each column 35, 36 (FIG. 6). The evaluation circuits 29 can, however, also be combined into groups and have a respective single common output 55 to 59.

The operating mode of the invention is as follows:

A stream of fibres in the form of flocks 60 consisting, for example, of cotton fibres and being conveyed in an air stream 61, arrives in the condenser 1. The flocks 60 possibly contain not only cotton fibres but also foreign material such as, for example, fibres of a different type or different colour, foreign materials, woven or plastic parts etc. The condenser 1 separates the flocks 60 from the air stream 61 and guides the flocks to the opener 2 which then at least separates or opens the flocks when they exceed a certain measurement. The flocks 60 then arrive in the retaining duct 3 where they collect and are pulled from below into the measuring duct 18. This takes place owing to the roller-shaped elements 14, 15, the teeth 21, 22 of which detect the fibre material, compress it and guide it so separated or offset portions 62, 63 are formed where the fibre mass is optically detected, as described hereinafter. The stream of fibres is then expelled downwards and suctioned off by a further air stream, thus passing the separating device 8. This operates in a manner known per se in that with a compressed air pulse it shoots away in a different direction the foreign parts of the stream of fibres detected by the foreign material detection device 4, so these parts arrive in the foreign material collector 7. The remaining part of the stream of fibres leaves the device cleaned via the discharge duct 6 and can be fed to a further processing stage.

The fibres which are caught in the portion 62 located directly upstream from the light-transmitting element 24 and which completely cover the background are illuminated by the light source 50 via the light-transmitting element 24. The light reflected by the fibres arrives via the lens system 27 (FIG. 3) and the light-transmitting element 28 into the colour filter 38 (FIG. 7) where proportions of the red (R), the green (G) and the blue (B) light are filtered from the reflected light and transmitted separately to the measuring elements 37. These proportions are transformed into voltage values in the current/voltage transformer 39. The voltages for each fibre produced in this way are transmitted via the amplifier 40 to the analogue/digital transformer 41 which is clocked via a signal from the position sensor 51 from the line 52 and therefore by the position of the light-transmitting element 24 on the roller-shaped elements 14, 15. The voltages achieved separately for each colour are fed in accordance with the respective colour (red, green, blue) to the element 42 for linearising and standardising and then to the memory 44 and, totalled to a total intensity, transmitted to the intensity measuring device 43. The standardised values of the voltages for the individual colours are guided to the circuit for evaluation of the light intensity 43 to determined the colour intensity. Nominal values for each colour and each intensity are determined in the unit 46, an input for calibration via the terminal 53 serving this purpose. Tolerance values are also associated with each nominal value in the unit 47, these being determined via the terminal 54. The signals from the memory 44 are simultaneously fed to the time-delay circuit 45 which delays them for as long as a flock requires to arrive upstream from the separating device 8 from the portion 63 in the measuring duct 18 where it is detected. At this point in time a decision is made in the comparator 48 whether a signal is to be output for separation via the output 49. This occurs when the delayed values for the intensity of the individual colours from the delay circuit 45 are outside the tolerant values input by the unit 47. This takes place owing to a comparison in the comparator 48. The device shown in FIG. 7 is part of the control unit 9 (FIG. 1) and this means that the signal for separation is transmitted via the control line 11 to the separation device 8 which expels the part of the stream of fibres currently in its sphere of action with a compressed air pulse. As soon as the portion 63 (FIG. 3) with the light-transmitting element 23 is situated upstream of the lens system 27' of the evaluation unit 19 precisely the same processes are repeated. Thus the evaluation unit 19 and then the evaluation unit 20 are used alternately.

The above-described processes taking place in the evaluation units 19, 20 can also analogously be described in a second manner, namely as follows and with the aid of FIG. 9. The signals at the output 49 which are individually output in time cycles for each colour (R=red, G=green, B=blue) can be shown in a three dimensional view in a space 64. In this space 64, each colour can be understood as a vector R, G, B, wherein the vectors R, G, B can be combined into a resultant vector H when the vectors R, G and B have the same unit size. In practice this is not so and from the measured intensity values for each colour a correspondingly dimensioned vector (R, G and B) results which combined give a vector RGBH. A tolerance region shown here by the cube 65 is defined for this by the tolerances set in the unit 47. If the end point of the vector RGBH is in this tolerance region 65 there is no reason to separate flocks. But if the vector is in a region 66 next to the tolerance region, then there is a reason for this.

Algorithms can also be input which, for example, cause a plurality of adjacent separation devices 8 to be activated together. A plurality of evaluation circuits 29 as shown in FIG. 8 are then combined into groups with respective common outputs. Signals to separate foreign materials are thus output via the outputs 55, 56, 57, 58 and/or 59. Further tolerances could, for example, be input for this purpose which, when exceeded, trigger common separations of this type although the tolerances for a single output have not yet been exceeded.

It remains to be added here that all inputs, in particular those for which the terminals 53 and 54 are also provided, should take place via the input and output unit 12 transmitting these to the control unit 9.

If a device is used as shown in FIG. 4 or 5 it is advantageous to keep the wall 30 or the roller 32 to a colour which is similar to the pure fibre material. This also applies to the teeth 21, 22. It is also conceivable, instead of optical elements having a round shape, to use elongated ones and this could reduce the number of columns 34, 35 to one.

What is claimed is:

1. A device for identifying and expelling foreign material in a stream of fibres consisting of compressed textile fibres, comprising at least one roller-shaped element having elements for engagement with positive fit in the stream of fibres and for driving the stream of fibres, and light-transmitting elements arranged between said engagement elements.

2. The device according to claim 1, wherein two roller-shaped elements are arranged opposing one another having teeth as elements for engagement with positive fit which are arranged to mesh with one another without contact and which form a measuring duct with offset portions for the stream of fibres.

3. The device according to claim 1, wherein the light-transmitting elements are arranged side by side in columns and rows in the roller-shaped element.

4. The device according to claim 1, further including an evaluation unit in the roller-shaped element for the evaluation of signals from the stream of fibres.

5. The device according to claim 4, wherein the evaluation unit has filters to separate the received light into a plurality of colours.

6. The device according to claim 4, wherein a common evaluation unit connected in one position of the roller-shaped element to a respective light-transmitting element is associated with a plurality of optical elements.

* * * * *